United States Patent [19]

Sparks

[11] 4,449,594

[45] May 22, 1984

[54] METHOD FOR OBTAINING PRESSURIZED CORE SAMPLES FROM UNDERPRESSURIZED RESERVOIRS

[75] Inventor: Ronald L. Sparks, Midland, Tex.

[73] Assignee: Allied Corporation, Morris Township, Morris County, N.J.

[21] Appl. No.: 403,841

[22] Filed: Jul. 30, 1982

[51] Int. Cl.[3] ..... E21B 25/08

[52] U.S. Cl. ..... 175/59; 175/69; 175/226

[58] Field of Search ..... 175/25, 48, 58, 59, 175/60, 69, 226; 166/250, 303, 309; 73/155

[56] References Cited

U.S. PATENT DOCUMENTS

| | | | |
|---|---|---|---|
| 3,112,799 | 12/1963 | Gallus | 175/59 |
| 3,146,837 | 9/1964 | Bridwell | 175/59 |
| 3,463,231 | 2/1968 | Hutchison et al. | 166/303 |
| 3,548,958 | 12/1970 | Blackwell et al. | 175/233 |
| 3,819,519 | 6/1974 | Sharman et al. | 175/69 |
| 4,121,674 | 10/1978 | Fischer et al. | 166/309 |
| 4,159,643 | 7/1979 | Watkins | 73/155 |

OTHER PUBLICATIONS

"Bureau of Mines–American Petroleum Institute Pressure Core Barrel" by D. B. Taliaferro and R. E. Heithhecker.

A. L. McFall, "Recent Developments in Pressure Coring", Feb. 3–7, 1980, pp. 6–9.

H. Lorenz, "Air, Mist and Foam Drilling Has Worldwide Application", Jun. 1980, pp. 188–189, 192–193.

J. A. Krug et al., "Charts Help Find Volume, Pressure Needed for Foam Drilling", Feb. 7, 1982, pp. 61–64.

R. S. Millhone, et al., "Factors Affecting Foam Circulation in Oil Wells", Copyright, 1972.

Drill Bit, "Drilling Equipment & Technology", Jul. 1981, pp. 96–98.

*Primary Examiner*—Stephen J. Novosad

*Assistant Examiner*—William P. Neuder

*Attorney, Agent, or Firm*—Paul Yee; Ernest D. Buff; Gerhard H. Fuchs

[57] ABSTRACT

The invention provides a method for obtaining a balanced, pressurized core sample from an underpressurized geological reservoir formation. A pressure core sampling well is drilled to a preselected depth and the bottom hole reservoir pressure therein is determined. A computer is programmed to compute predicted bottom hole foam pressures at the bottom of the well produced by a stable foam coring fluid, having a preselected composition, which is introduced into the well under preselected control pressures. Measurements are than made of actual bottom hole foam pressures at the bottom of the well produced by the foam when it is introduced into the well at preselected control pressures and under core sample drilling conditions. A comparison is made between the measured bottom hole foam pressures and the computer predicted bottom hole foam pressures to derive a correlation function and to select a correlated core pressure. The selected correlated control pressure produces a foam balance pressure at the bottom of the well which substantially balances the bottom hole reservoir pressure. A core sample is then drilled while said foam is introduced into the well under the correlated control pressure. The core sample is encapsulated while the reservoir pressure within the sample is balanced by the bottom hole foam balance pressure to produce the balanced, pressurized core sample.

10 Claims, 6 Drawing Figures

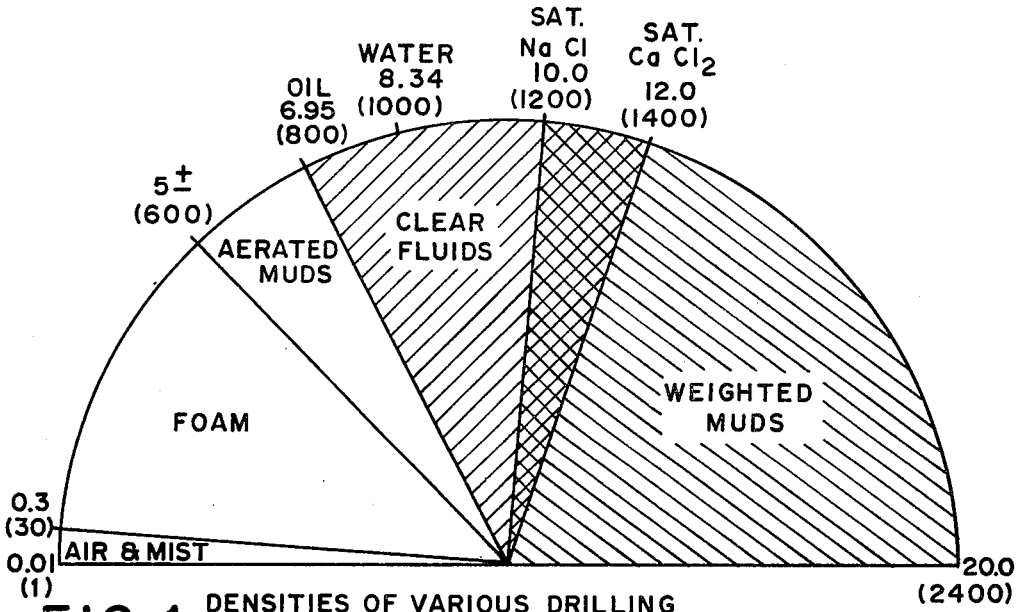
FIG. 1 DENSITIES OF VARIOUS DRILLING FLUIDS – lb/gal (kg/m$^3$)
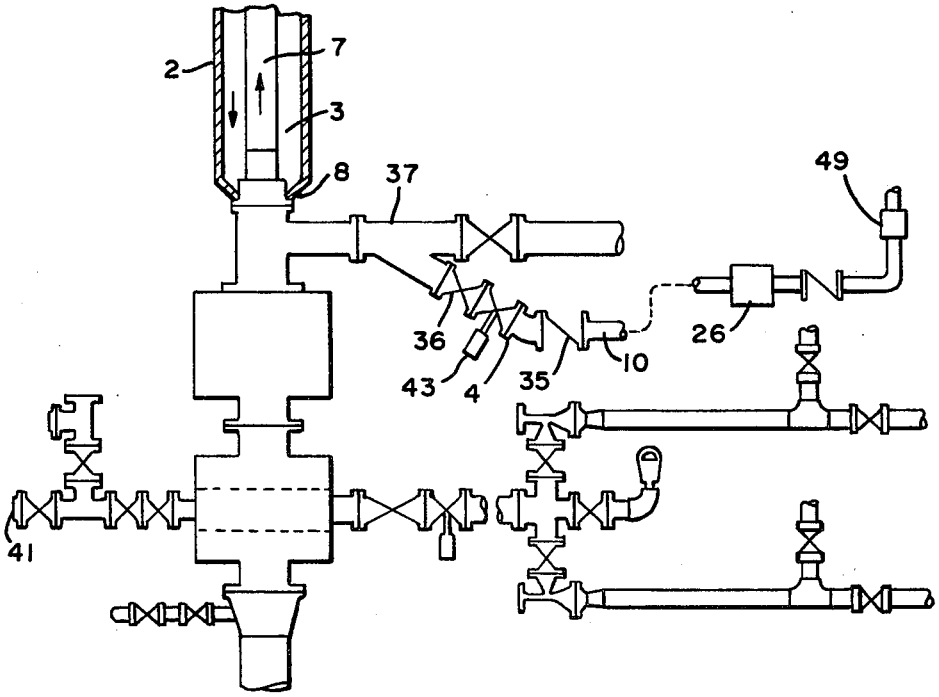
FIG. 2

ANNULAR PRESSURE (SURFACE) VERSUS BOTTOM HOLE PRESSURE (MEASURED & CALCULATED)

METHOD FOR OBTAINING PRESSURIZED CORE SAMPLES FROM UNDERPRESSURIZED RESERVOIRS

BACKGROUND OF THE INVENTION

1. Field of the Invention

The invention relates to the taking of core samples from geological reservoir formations. More particularly, it relates to obtaining a balanced, pressurized core sample from an underpressurized geological reservoir formation using a stable foam as a drilling fluid and pressurizing fluid.

2. Description of the Prior Art

Pressurized core samples are useful for obtaining residual saturations and in-situ gas-oil ratios in deep geological reservoirs. U.S. Pat. No. 3,548,958 discloses a pressure core barrel for taking pressurized core samples. U.S. Pat. No. 3,463,231 discloses a method for drilling wells using foam as a drilling fluid. A paper by Alan L. McFall entitled "Recent Developments in Pressure Coring", paper SAND80-0253C presented at the Energy Sources Technology Conference and Exhibition, New Orleans, Feb. 3–7, 1980; discloses the taking of pressurized core samples using a brine-based polymer as a coring fluid. A number of papers discuss well drilling using foam as a drilling fluid. For example: Lorenz, Howard, "Air, Mist and Foam Drilling Has World-Wide Application", World Oil (June 1980), page 187–193; Krug, Jack A. and Mitchell, B. J., "Charts Help Find Volume, Pressure Needed for Foam Drilling", Oil and Gas Journal, (Feb. 7, 1972), page 61–64; and Millhone, R. S., Haskin, C. A., and Beyer, A. H., "Factors Affecting Foam Circulation in Oil Wells", paper SPE 4001 presented at SPE 47th Annual Fall Meeting, San Antonio, Oct. 8–11, 1972.

For the purposes of this invention and as used in the specification and claims, a stable foam is a completely mixed gas and liquid dispersion where the liquid is the continuous phase and the gas is the discontinuous phase. Under normal conditions, a stable foam is a compressible fluid which behaves as a Bingham plastic fluid, as discussed in the above reference authored by Krug and Mitchell.

Unique problems, however, must be overcome before a pressurized core sample can be taken using foam as a core drilling fluid. A major problem stems from the fact that pressure balance is an absolute requirement for successful pressure coring. Too large a pressure overbalance during coring operations causes a flushing of the core with mud filtrate, thereby altering the core saturations and properties. Underbalance of pressure during coring operations causes an exuding of core fluids, also altering the in-situ saturations. Thus, precise foam behavior at the well bottom (i.e. bottom hole) during pressure coring operations must be known. However, there has heretofore been no method for precisely predicting the foam behavior as a function of the foam composition and a control pressure applied to the foam. Without an accurate method of accomplishing this critical step, reliable and practical pressure coring using foam cannot be performed.

SUMMARY OF THE INVENTION

The invention provides a method and apparatus for obtaining a balanced, pressurized core sample from an underpressurized geological reservoir formation. A pressure core sampling well is drilled to a preselected depth, and the bottom hole reservoir pressure at the bottom of the well is determined. A computer is programmed to compute predicted bottom hole foam pressures at the bottom of the well produced by a stable foam coring fluid, having a preselected composition, which is introduced into the well under preselected control pressures. A measuring means measures bottom hole foam pressures present at the bottom of the well produced by the foam when the foam is introduced into the well at the preselected control pressures and under core sample drilling conditions. A comparator means compares the measured bottom hole foam pressures with the computer predicted bottom hole foam pressures to derive a correlation function and to select a correlated control pressure. The selected correlated control pressure produces a foam balance pressure at the bottom of the well which substantially balances the reservoir pressure. A drilling means drills a core sample while foam is introduced into the well under the correlated control pressure, and an encapsulation means encapsulates the core sample while the reservoir pressure within the core sample is balanced by the bottom hole foam balance pressure, thereby producing a balanced, pressurized core sample.

By using a foam as the pressure coring fluid, pressure cores can be taken where the hydrostatic pressure gradient is less than 0.25 psi per foot. Thus, pressure core samples can be taken from underpressurized reservoirs such as a coal seam or a reservoir containing tar sands. No measurable foam invasion into the core sample occurs, and the core samples are more quickly and easily processed for analysis; the analysis can be accomplished almost two times faster than an analysis performed on a pressurized core sample taken with the use of ordinary coring fluids.

BRIEF DESCRIPTION OF THE DRAWINGS

The invention will be more fully understood and further advantages will become apparent when reference is made to the following detailed description of the preferred embodiment of the invention and the accompanying drawings in which:

FIG. 1 is a pie chart showing densities of various drilling fluids;

FIG. 2 is a schematic representation of a rotating head and blow-out preventer design useful for foam coring operations;

DESCRIPTION OF THE PREFERRED EMBODIMENTS

Figure 3:
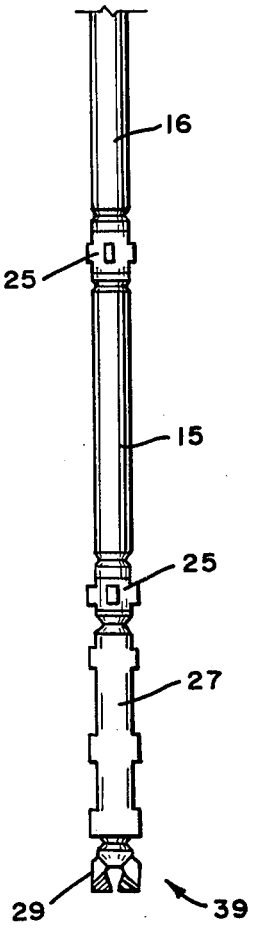
FIG. 3 is a bottom hole coring assembly used for pressure coring.

When a conventional core sample is drilled and brought to the surface, the pressure on that core and the fluids within the core is gradually reduced from reservoir pressure to atmospheric pressure. During this pressure reduction, dissolved gases in the fluids are liberated and flush much of the liquid saturation out of the core. For this reason, conventional core saturation data is not an accurate representation of bottom hole conditions. To obtain a core sample having saturations equivalent to those of the reservoir, a pressure equal to the reservoir pressure must be maintained in the core until it is analyzed in a laboratory.

U.S. Pat. No. 3,548,958, for "Pressure Core Barrel" issued Dec. 22, 1970 to R. J. Blackwell, et al., hereby incorporated by reference, discloses a suitable pressure core barrel. This barrel is similar to a conventional core barrel in that it consists of a stationary inside barrel and a rotating outside barrel to cut the core. The major difference, however, is that the barrel mechanism may be tripped to close valves at the top and the bottom of the barrel to encapsulate and seal the core sample at bottom hole pressure conditions. In this manner, the reservoir pressure and fluid saturations are maintained as the core is brought from reservoir pressure and temperature to surface pressure and temperature. Once on the surface, the entire barrel is frozen in its sealed condition to immobilize the fluids and trap the free gas saturation. Once frozen into an immobile state, the core may be depressurized. The inner barrel is then removed from the outer barrel and sent to a laboratory for analysis. At the laboratory, the inner barrel is stripped from the actual core and the core is sectioned into appropriate lengths. These lengths are placed in a sealed chamber to thaw and, during the thawing process, the evolved gas and liquids are collected and measured. The remainder of the core is then analyzed for saturations in a conventional manner, and a summing is then performed to determine the original reservoir saturation conditons.

Due to the requirement of maintaining a precise pressure balance during coring operations, the taking of pressurized core samples has been limited to reservoirs with pressure gradients greater than 0.25 psi per foot. Stable foam has been successfully used as a drilling medium and is disclosed in U.S. Pat. No. 3,463,231, "Generation and Use of Foamed Well Circulation Fluids" issued Aug. 26, 1969 to S. Hutchison, et al., hereby incorporated by reference. However, no pressurized core samples have been taken using foam as the pressure coring fluid because a method for precisely predicting foam behavior at the well bottom during coring operations has been lacking.

The present invention provides a practical method for obtaining a balanced, pressurized core sample from an underpressurized geological reservoir formation. A pressure core sampling well is drilled to a preselected depth, and the bottom hole reservoir pressure at the bottom of the well is determined. A pressurized core sample is drilled while a stable foam coring fluid, having a preselected composition, is introduced into the well at a predetermined control pressure. The control pressure is selected to produce a resultant bottom hole foam pressure at the bottom of the well which substantially balances the reservoir pressure. The core sample is then encapsulated while the reservoir pressure within the core sample is substantially balanced with the bottom hole foam pressure, thus producing the balanced, pressurized core sample.

Figure 6:
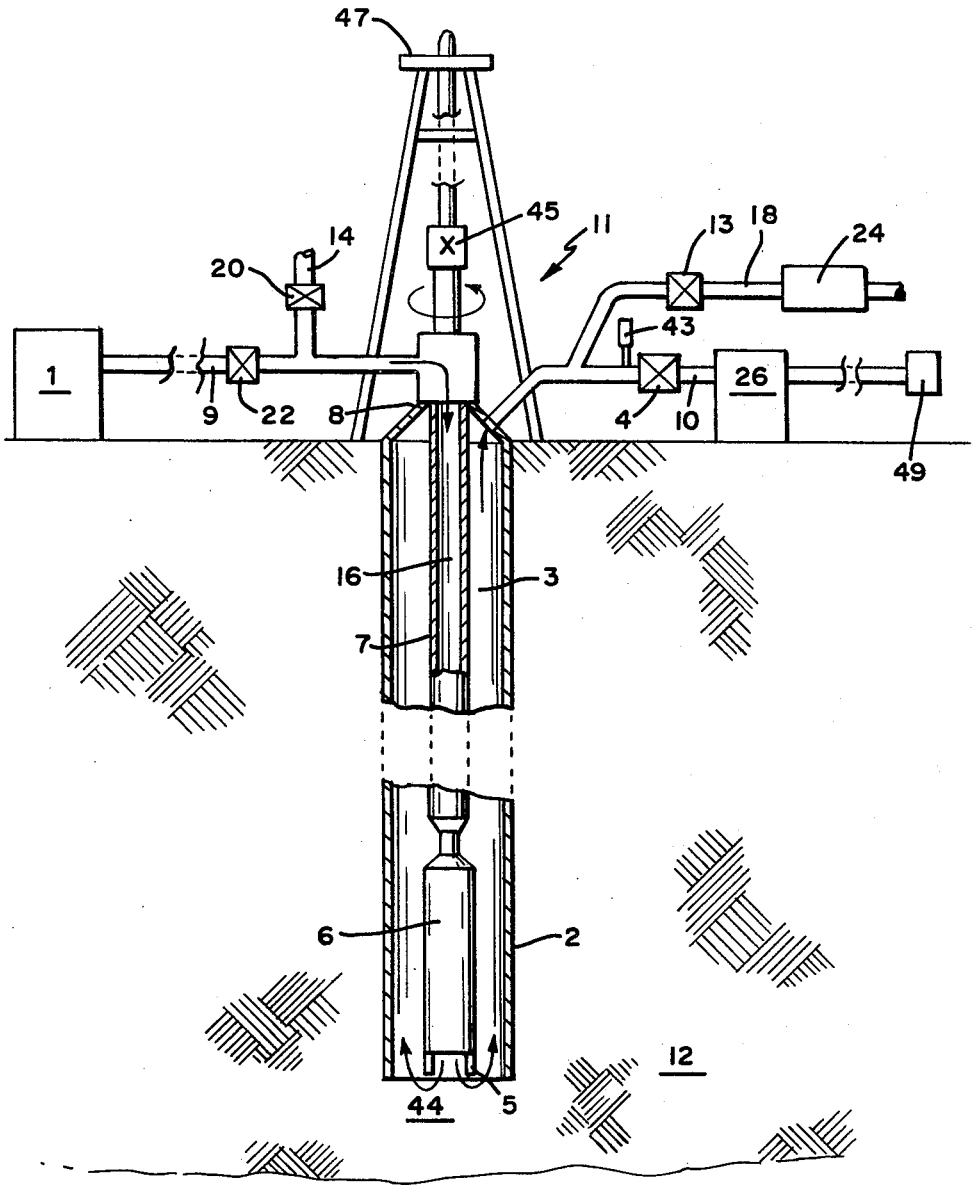
FIG. 6 is a schematic representation of a core sampling well.

FIG. 6 of the drawings shows a schematic representation of a pressure core sampling well 11 drilled into a geological reservoir formation 12. A foam means, such as foam generator 1 provides a stable foam coring fluid having a preselected composition, and a conventional drilling rig 47 provides a drilling means for drilling a pressurized core sample while the foam is introduced into well 11. Coring barrel 6 provides an encapsulation means for encapsulating the core sample, and a control means selects and maintains a preselected correlated control pressure on the foam in well 11 during the core drilling and core encapsulation operations.

During conventional drilling, a suitable drilling fluid is circulated into conduit 14 which directs the fluid into rotating head 8. The fluid then passes into an axial conduit 16 extending through drill pipe 7 which conducts the fluid down to a drill bit 5 located at the drilling zone 44. There the fluid lubricates and cools drill bit 5 as the bit cuts through the earth, and also serves as a transport means for carrying away the cuttings. The fluid then moves toward the surface of the earth through annulus 3 formed between drill pipe 7 and a concentrically located production pipe 2. At the surface, the foam leaves annulus 3 and passes through valve 13 and conduit 18 to a shale shaker 24 which separates solids from the drilling fluid. When taking a pressurized core sample using foam as the drilling fluid, valves 20 and 13 are closed and valves 22 and 4 are opened. Foam of a preselected composition is generated by foam generator 1 and introduced into conduit 9 which conducts the foam to rotating head 8. When the foam reaches drilling zone 44 by way of drill pipe 7, it not only lubricates and cools drill bit 5 and transports the cuttings but also provides a balance pressure when required. After moving up annulus 3 to the surface, the foam passes through annulus choke valve 4 which controls the level of backpressure on the foam before it exits through conduit 10 to a suitable foam breaker 26 and flare 49. Thus, choke valve 4 provides a regulated control pressure to the foam within annulus 3, and thereby precisely controls the foam pressure at drilling zone 44.

FIG. 2 shows a schematic representation of a rotating head and blow-out preventer used for foam coring operations. The foam is introduced into pipe 7 and conducted through rotating head 8 down into the well. In order to properly maintain bottom hole pressure while using foam, a good rotating head 8 capable of holding up to 500 psi of back pressure is required. After passing down the well through drill pipe 7, the foam returns to the surface through annulus 3 and enters flow line 37. Valves 35 and 36 are installed on flow line 37 so that fluid may be either diverted over a shale shaker in normal operations or through the back pressure choke 4 on the foam line during coring operations. Any killing fluids for killing the foam can be pumped in through kill line 41. Since the killing fluids will be substantially heavier than the foam, it is very possible for the well to go on a vacuum, and unless a full opening double check valve 35 arrangement is installed somewhere between flare 49 and the rotating head 8 in the foam line, the flare may possibly be drawn through the flow line and down into the well bore. For this reason, the flow line check valve must not be eliminated. During pressure coring operations, the annulus back pressure gauge 43 as well as the control for the adjustable choke 4 on the foam line are monitored and controlled.

After drilling the core sampling well to the desired preselected depth, one must accurately predict the precise foam behavior which will occur at the bottom of that particular core sampling well during actual core cutting and core encapsulating operations. One must be able to predict the dynamic foam pressure during core cutting, the static foam pressure during the encapsulation operation, and the foam pressure change which results from the collapse of the foam during the encapsulating operation. Preferably, the foam behavior should be predictable as a function of foam composition and the foam annulus control pressure measured at the ground surface by gauge 43.

To accomplish this, one must choose a suitable foam as the core drilling fluid. The ideal pressure coring foam exhibits minimum invasion into the core sample during an overbalanced pressure condition, is nonreactive with reservoir rocks and fluids, provides good drilling properties, is stable, has a low freezing point to allow easy removal of frozen cores and has a moderate viscosity to prevent a large change between static and dynamic bottom hole pressures. Preferably, the foam is produced with an air injection rate of about 300–500 scf/min because over this air injection rate, the change in bottom hole foam pressure is substantially linear over small changes in the air injection rate. Additionally, a change in liquid injection rate for a given air injection rate also results in a predictable bottom hole pressure behavior. These factors allow a limited application of empirical or field measurements to adjust any computer solutions. As long as the compressive pressure on the foam does not cause the bubbles to collapse, the foam bubble size at the well bottom remains larger than the pore throat size of the rock matrix, and the foam does not invade into the core sample. For example, an air injection rate of about 450 scf/min. combined with a liquid injection rate of about 23 gal/ min. of soap solution produces a foam suitable for pressure coring operations.

A pressure control means selects and maintains a precise, correlated control pressure on the foam in the well during the core drilling and core encapsulation operations. Preferably, the control means includes: a computer programmed to calculate predicted bottom hole foam pressures; a measuring means, such as pressure test tool 33, which measures bottom hole foam pressures actually produced under simulated coring conditions; a comparator means which compares the measured bottom hole foam pressures with the computer predicted bottom hole foam pressures to select a correlated control pressure; and a regulator means, such as choke valve 4, which maintains the correlated control pressure on the foam.

Figure 5:
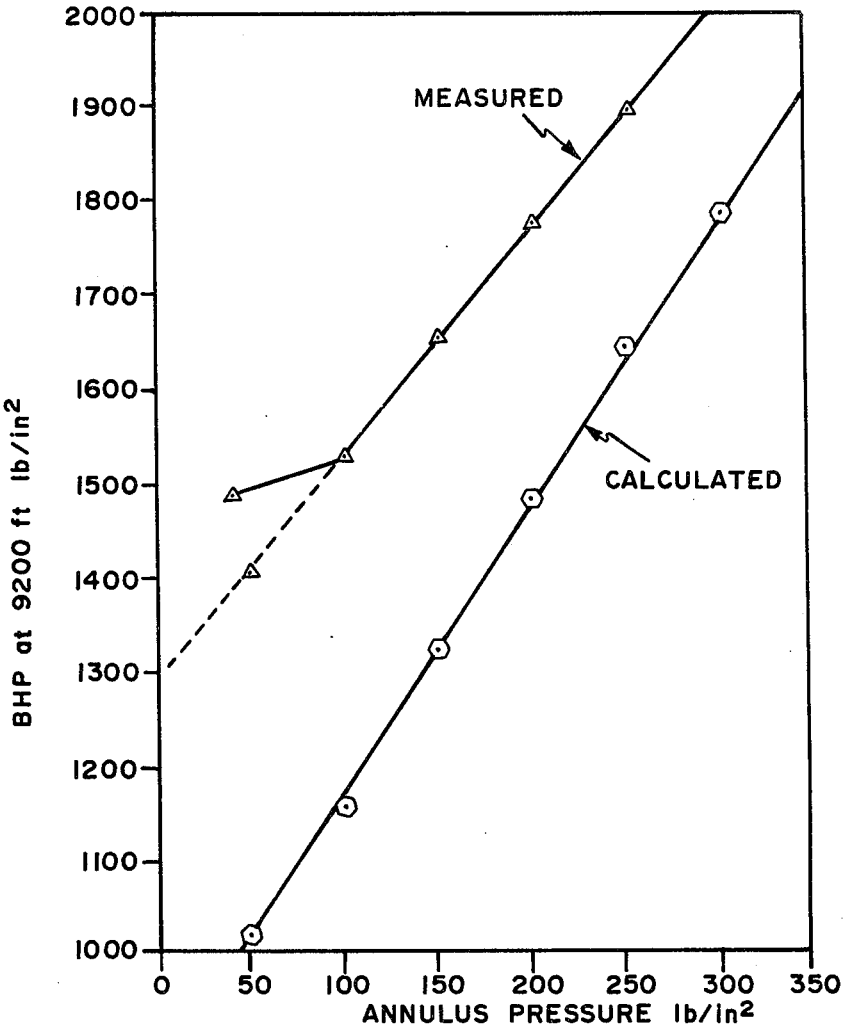
FIG. 5 is a graph showing surface control pressure versus bottom hole foam pressure.

To establish an initial working base line, a computer is programmed to compute predicted bottom hole foam pressures produced at the well bottom by a foam, having a preselected composition, which is introduced into the well under preselected control pressures. Under normal conditions a stable foam is a compressible fluid having non-linear characteristics, and with the evaluation methods disclosed by Krug and Mitchell, a suitable computer program can be prepared. By using the programmed computer and knowing the well depth, predicted bottom hole foam pressures can be computed as a function of foam composition, air injection rate, liquid injection rate and flow control back pressure. However, if a preselected foam composition is maintained by suitably controlling the air injection and liquid injection rates, predicted bottom hole foam pressures can be computed as a function of the control back pressure used to regulate the foam flow through annulus 3 and choke valve 4. The graph in FIG. 5 shows a representative plot of control (annulus) back pressure versus computer predicted bottom hole foam pressure (BHP).

The computed values of bottom hole foam pressure, however, are not accurate enough for pressure coring operations because of the many variables unique to the particular sampling well, such as well bore size, well configuration and drilling velocities, which cannot be adequately addressed by the computer program. Therefore, it is necessary to develop an empirical correlation function which precisely predicts bottom hole foam pressure during actual coring operations as a function of the annulus pressure controlled by valve 4. To develop the required correlation function, measurements are made of actual bottom hole foam pressures produced by the foam when it is introduced into the well at preselected control pressures and under core sample drilling conditions.

Figure 4:
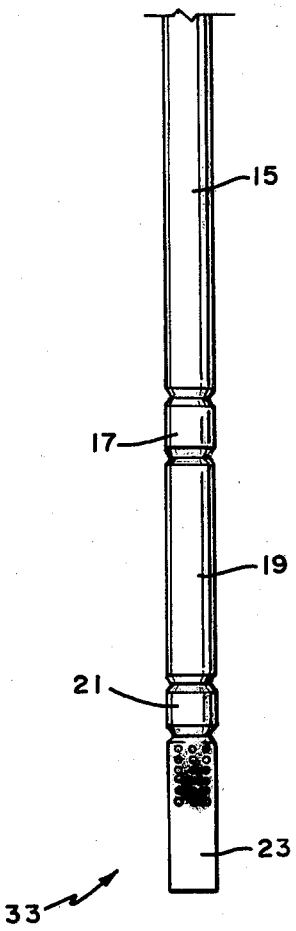
FIG. 4 is a foam pressure test tool used for pressure coring with foam.

To make the bottom hole foam pressure measurements, a special drill stem test tool was designed and constructed to precisely measure foam behavior under actual core sampling conditions. FIG. 4 shows a schematic representation of the pressure test tool 33 which connects to the bottom of the well drill pipe. Conventional drill collar 15, located at the bottom of the drill pipe, connects to a cross-over 17 which in turn connects to a conventional inside recording drill stem pressure recorder 19. Pressure recorder 19 measures down-hole fluid pressures inside the drill pipe. Positive choke assembly 21 connected to the bottom end of inside recorder 19 is comprised of a metal block with an aperature therethrough. The aperature is adapted to accurately simulate the actual pressure drop experienced by the foam drilling fluid as it flows through a coring drill bit. A standard, perforated drill stem test outside pressure recorder 23 connects below choke assembly 21 to measure and record down-hole fluid pressures in the production pipe area (i.e. bottom hole annulus pressure).

Pressure test tool 33 is positioned at the bottom of the well to measure foam behavior under actually expected core drilling conditions, including actual well configuration and expected drilling velocities. Foam is introduced into the well and control valve 4 is adjusted to provide preselected control back pressures to the annulus ranging from 0 psi of annulus control pressure to about 400 psi of control pressure. The drilling equipment and the foam equipment are then shut down for a short time to simulate the time interval needed to close the valves which effect the encapsulation of the core sample. This provides needed data on the amount of pressure loss caused by the collapse of the foam.

The test recorders are then removed from the well, and a comparison is made between the measured bottom hole foam pressures and the computer predicted bottom hole foam pressures to derive a correlation function and to select a correlated control pressure. The correlated control pressure is the control pressure that produces a foam balance pressure at the bottom of the well which substantially balances the reservoir pressure.

A conventional core drilling assembly 39, as representatively shown in FIG. 3, is then used to drill a pressurized core sample. Assembly 39 is comprised of several drill collars 16 weighing about 20,000 pounds total, attached to the end of the drill pipe. A stabilizer 25 is interposed between the upper drill collars 16 and the final drill collar 15 to provide stabilization during the core drilling operations. A pressure coring barrel 27 connects to another stabilizer 25 which in turn couples the barrel to drill collar 15. A core cutting bit 29 then connects to barrel 27. In operation, assembly 39 is run into the well hole and foam circulation is established at the predetermined, correlated control pressure needed to produce a bottom hole foam pressure which balances the bottom hole reservoir pressure. The drilling equipment is then started and bit 29 cuts an annular shaped path through the earth leaving a cylindrically shaped core which extrudes into barrel 27. After drilling a core of desired length, the drilling equipment is stopped and valves are actuated within the barrel to encapsulate the core sample while the foam balance pressure is established and maintained by the foam drilling fluid. The encapsulated core is then removed from the well and frozen to prepare it for transport and analysis.

EXAMPLE

A core sampling well was drilled to a depth of about 9,200 feet (2,806 meters) into an oil reservoir having a 1,250 psi reservoir pressure and a 0.14 psi per foot hydrostatic pressure gradient. This pressure gradient required the use of a pressure coring fluid having a fluid weight of approximately 2.6 pounds per gallon. Referring to FIG. 1, it can be seen that the only acceptable drilling fluid to obtain a 2.6 pounds per gallon gradient would be a foam system. The selected foam was formed by combining a soap solution introduced at 23 gallons per minute with air introduced at 450 scf per minute. Predicted bottom hole foam pressures at 9,200 feet produced by the selected foam were calculated by computer and plotted as a function of applied annulus control pressure, as shown in the graph of FIG. 5. Pressure test tool 33 was then introduced into the well to measure the actual bottom hole foam pressures produced when the foam is introduced into the well at preselected control pressures. The selected control pressures ranged from an initial 0 psi annulus pressure and increased in increments of 50 psi with 10–15 minute intervals between each increment until a final annulus pressure of 350 psi was achieved. Then the back pressure was reduced to 200 psi and stabilized for 20 minutes. The equipment was then shut down for 10 minutes to simulate the time required to close the valves in the pressure coring barrel, after which the test recorders were pulled out of the hole to retrieve the measured pressure data. The measured bottom hole foam pressures were compared with the computer predicted bottom hole foam pressures, and by using a simple least squares fit between computer calculated data and actually measured data, the following correlation function was derived.

$$P_m = 0.783\ P_c + 618$$

where:

$P_m$ = measured bottom hole foam pressures $P_c$ = computer predicted bottom hole foam pressures.

Since a foam pressure drop of approximately 255 psi was measured over the 10 minute interval which corresponded to the time required to complete the encapsulation operation, the 255 psi value was added to the 1,250 psi reservoir pressure to compensate for any pressure drop during the core encapsulation. This resulted in a required bottom hole pressure of 1,505 psi. Using the correlation function, the 1,505 psi pressure ($P_m$) corresponded to a computed bottom hole foam pressure ($P_c$) of 1,132 psi. Referring to FIG. 5 it is apparent that the 1,132 psi foam pressure in turn corresponded to a regulated annulus control pressure of approximately 90 psi. As a result, during the core drilling and core encapsulation operations, an annulus control pressure of 90 psi was maintained. An 8 ft. core sample was then drilled in about 15 minutes of drilling. When the completed core barrel containing the encapsulated core sample was removed from the well and frozen with dry ice, the internal pressure was measured and found to be 1,288 psi, which was very close to the expected 1,250 psi. Upon analysis of the core sample, no measurable invasion of the foam into the core sample was found.

The laboratory analysis revealed additional, unexpected benefits to using foam as a coring medium. Since the foam itself was primarily gaseous, the residual fluid from the foam was so small that none of the traditional mud chipping was required to process the core. This increased the speed at which the cores could be analyzed by a factor of nearly two. Additionally, the gaseous element of the foam was composed primarily of nitrogen and oxygen (which did not exist in the reservoir in significant quantities) and could be factored out of the analysis for any highly fractured or vugular cores.

Having thus described the invention in rather full detail, it will be understood that these details need not be strictly adhered to but that various changes and modifications may suggest themselves to one skilled in the art, all falling within the scope of the invention as defined by the subjoined claims.

I claim:

1. A method for obtaining a balanced, pressurized core sample from an underpressurized geological reservoir formation, comprising the steps of:

(a) drilling a pressure core sampling well to a preselected depth;

(b) determining a bottom hole reservoir pressure at the bottom of said well which is to be balanced;

(c) drilling a pressurized core sample while a stable foam coring fluid, having a preselected composition, is introduced into said well at a predetermined empirically correlated control pressure selected to produce a resultant bottom hole foam pressure at the bottom of said well that substantially balances said reservoir pressure; and (d) encapsulating said core sample, while said reservoir pressure within said core sample is substantially balanced with said bottom hole foam pressure, to produce said balanced, pressurized core sample.

2. The method as recited in claim 1, wherein said foam is comprised of air and a soap solution.

3. A method as recited in claim 1, further comprising the step of maintaining a foam bubble size at the well bottom which is larger than the pore throat size of the rock matrix of said reservoir formation during said drilling of said pressure core sample.

4. A method as recited in claim 1, wherein said foam composition is selected to provide a substantially linear change in bottom hole foam pressure over small changes in air injection rate.

5. A method as recited in claim 4, wherein said foam is produced with an air injection rate of about 300–500 scf/min.

6. A method for obtaining a balanced, pressurized core sample from an underpressurized geological reservoir formation, comprising the steps of:

(a) drilling a pressure core sampling well to a preselected depth;

(b) determining the bottom hole reservoir pressure at the bottom of said well that is to be balanced;

(c) programming a computer to compute predicted bottom hole foam pressures at the bottom of said well produced by a stable foam coring fluid, having a preselected composition, which is introduced into said well under preselected control pressures;

(d) measuring bottom hole foam pressures present at the bottom of said well produced by said foam when said foam is introduced into said well at said preselected control pressures and under core sample drilling conditions;

(e) comparing said measured bottom hole foam pressures with said computer predicted bottom hole foam pressures to derive a correlation function and select a correlated control pressure, said correlated control pressure producing a foam balance pressure at the bottom of said well which substantially balances said reservoir pressure;

(f) drilling a core sample while said foam is introduced into said well under said correlated control pressure; and (g) encapsulating said core sample while said reservoir pressure is balanced with said balancing foam pressure to produce said balanced, pressurized core sample.

7. The method as recited in claim 6 wherein said step (d) further comprises measuring said bottom hole foam pressures with a pressure test apparatus, comprising:

(a) an inside recording drill stem pressure recorder connected to a well drilling means;

(b) a choke means connected to said inside pressure recorder for providing a fluid pressure drop therethrough which substantially equals the fluid pressure drop experienced by said foam as it flows through a coring drill bit; and (c) a drill stem outside pressure recorder connected to said choke means.

8. An apparatus for obtaining a balanced, pressurized core sample from a pressure core sampling well drilled into an under pressurized geological reservoir formation having a reservoir pressure therein, comprising:

(a) foam means for providing a stable foam coring fluid having a preselected composition;

(b) drilling means for drilling a pressurized core sample while said foam is introduced into said well;

(c) encapsulation means for encapsulating said core sample; and (d) pressure control means for selecting and maintaining a preselected, correlated control pressure on said foam within said well during core drilling and core encapsulation, said correlated control pressure providing a resultant bottom hole foam pressure at the bottom of said well that substantially balances said reservoir pressure.

9. The apparatus as recited in claim 8, wherein said pressure control means, comprises:

(a) a computer programmed to compute predicted bottom hole foam pressures at the bottom of said well produced by said foam which is introduced into said well at preselected control pressures;

(b) measuring means for a measuring bottom hole foam pressures produced by said foam when said foam is introduced into said well at said preselected control pressures and under core sample drilling conditions;

(c) comparator means for comparing said measured bottom hole foam pressures with said computer predicted foam pressures to derive a correlation function and select said correlated control pressure; and (d) regulator means for maintaining said correlated control pressure on said foam.

10. The apparatus as recited in claim 9, wherein said measuring means, comprises:

(a) an inside recording drill stem pressure recorder connected to said well drilling means;

(b) a choke means connected to said inside pressure recorder for providing a fluid pressure drop therethrough which substantially equals the fluid pressure drop experienced by said foam as it flows through a coring drill bit; and (c) a drill stem outside pressure recorder connected to said choke means.

* * * * *